US008747181B1

(12) United States Patent
Wiseman et al.

(10) Patent No.: US 8,747,181 B1
(45) Date of Patent: Jun. 10, 2014

(54) TOY VEHICLE AND PLAYSET THEREFOR

(75) Inventors: Andy Wiseman, Bella Vista, AR (US); Anton Erick Martinson, New Prague, MN (US); Corey Feit, St. Louis, MO (US); Chad Stuemke, St. Louis, MO (US); Dale Picolet, St. Louis, MO (US); Hak Yau Hung, Happy Valley (HK); Woo Shou Kenneth Ting, Hong Kong (HK)

(73) Assignee: RedWoodVentures Limited, Hong Kong (HK)

( * ) Notice: Subject to any disclaimer, the term of this patent is extended or adjusted under 35 U.S.C. 154(b) by 474 days.

(21) Appl. No.: 13/068,614

(22) Filed: May 16, 2011

Related U.S. Application Data

(60) Provisional application No. 61/404,368, filed on Oct. 4, 2010.

(51) Int. Cl.
*A63H 18/10* (2006.01)

(52) U.S. Cl.
USPC ..... 446/444; 446/129

(58) Field of Classification Search
USPC ..... 446/129, 130, 133, 136, 446, 460, 456, 446/465; 104/242, 305, 281, 283, 286
See application file for complete search history.

(56) References Cited

U.S. PATENT DOCUMENTS

| | | | | |
|---|---|---|---|---|
| 2,903,821 | A * | 9/1959 | Favre | 446/130 |
| 4,221,076 | A * | 9/1980 | Ozawa | 446/445 |
| 4,550,910 | A * | 11/1985 | Goldfarb et al. | 104/305 |
| RE32,106 | E | 4/1986 | Lemelson | 446/138 |
| 4,652,247 | A | 3/1987 | Goldfarb et al. | 446/164 |
| 4,655,727 | A | 4/1987 | Swisher et al. | 446/470 |
| 4,955,537 | A | 9/1990 | Bratovz | 238/10 |
| 5,752,678 | A | 5/1998 | Riley | 446/288 |
| 5,766,056 | A | 6/1998 | Tsai | 246/415 |
| 5,931,714 | A * | 8/1999 | Johnson | 446/129 |
| 6,089,466 | A | 7/2000 | Fulton et al. | 238/10 |
| 6,102,770 | A * | 8/2000 | Cyrus et al. | 446/444 |
| 6,227,932 | B1 * | 5/2001 | Ngai | 446/444 |
| 6,322,415 | B1 * | 11/2001 | Cyrus et al. | 446/130 |
| 6,527,619 | B1 | 3/2003 | Agostini et al. | 446/435 |
| 7,090,556 | B2 * | 8/2006 | Maleika | 446/446 |
| 7,549,906 | B2 * | 6/2009 | Bedford et al. | 446/444 |
| 7,749,046 | B2 * | 7/2010 | Miva et al. | 446/462 |
| 2009/0325460 | A1 * | 12/2009 | Leonov | 446/468 |

* cited by examiner

*Primary Examiner* — Nini Legesse
(74) *Attorney, Agent, or Firm* — Smith Hurst PLC; Meredith K. Lowry

(57) ABSTRACT

A toy vehicle track and vehicle therefor having an actuator mechanism operably coupled with the motor and configured to remove power from the motor once the actuator mechanism senses the toy vehicle has exceeded a first speed provided by battery-powered propulsion and reached a second speed provided by either the vehicle being moved manually by a user or by moving downhill. Once the actuator mechanism has activated, the vehicle moves into free-wheeling mode and remains in that mode until the actuator mechanism senses that the toy has moved from the second speed to a third speed slower than the battery-powered propulsion speed.

15 Claims, 17 Drawing Sheets

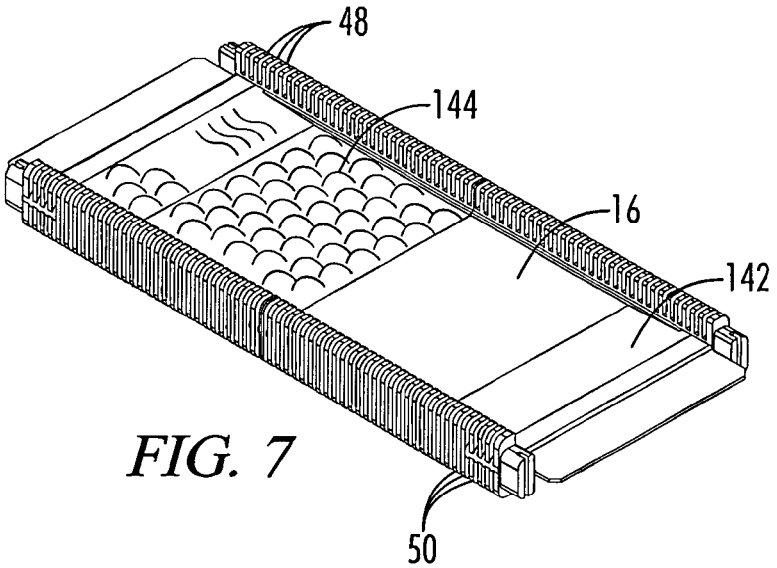
FIG. 7
FIG. 8
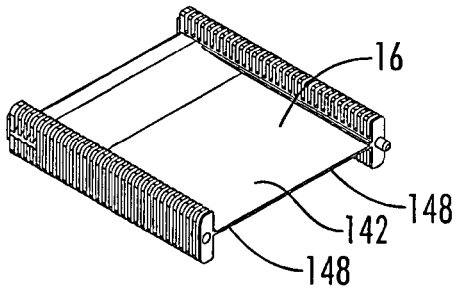
FIG. 9
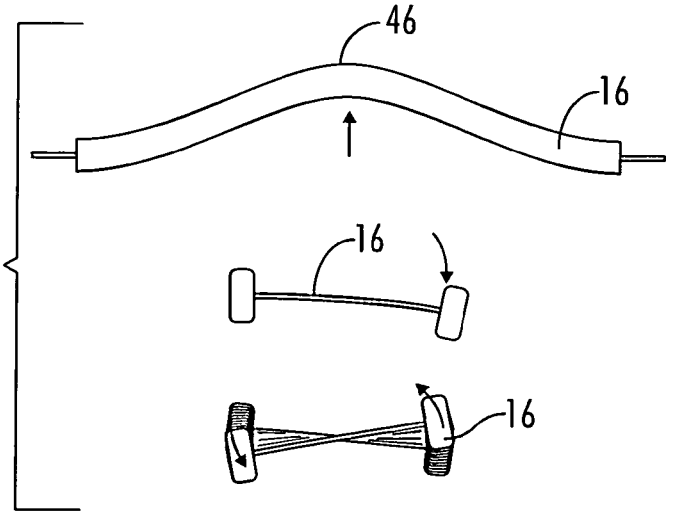

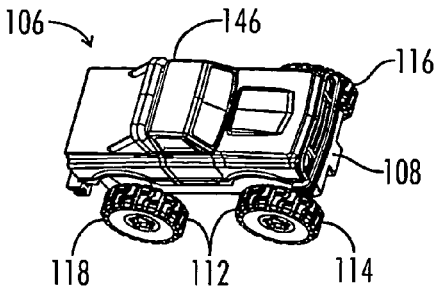
FIG. 26
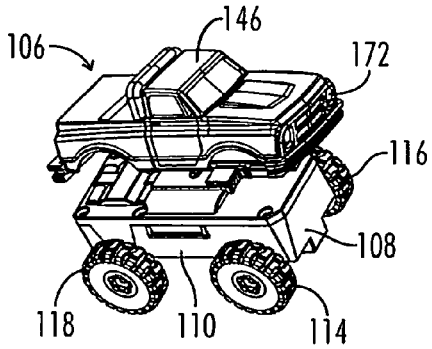
FIG. 27
FIG. 28
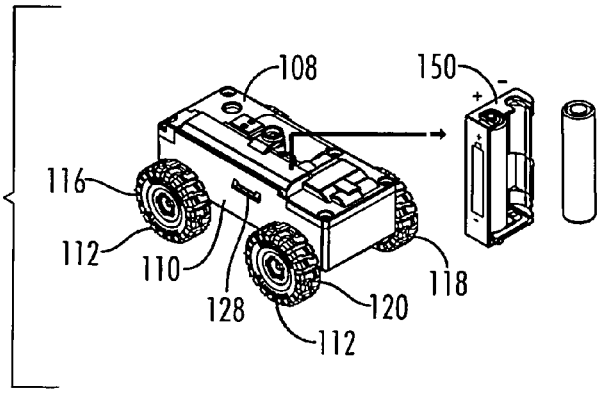
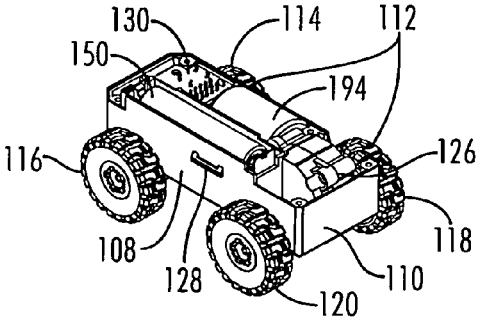
FIG. 29
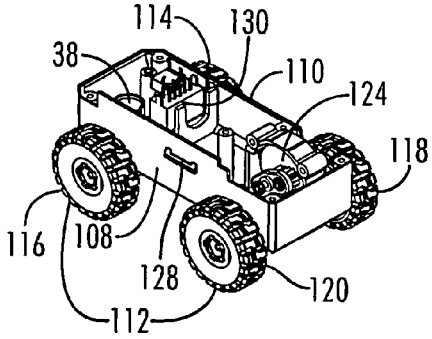
FIG. 30

TOY VEHICLE AND PLAYSET THEREFOR

CROSS-REFERENCE TO RELATED APPLICATIONS

This application claims priority to and is a continuation-in-part of U.S. provisional application Ser. No. 61/404,368 filed on Oct. 4, 2010.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to toy vehicles and to the track used therewith.

2. Description of the Known Art

Toy vehicles have proven to be an extremely popular and long-lasting toy product. In response to this extended popularity, practitioners in the art have endeavored to increase the appeal of toy vehicles to consumers by designing and creating a variety of innovative toy vehicles and toy vehicle track sets.

Toy vehicles, such as toy cars and trucks, are widely available in various configurations including those operated by a small electric motor or purely mechanical vehicles with wheels that spin freely ("free-wheeling"). Some of these toy vehicles include a mechanized accessory or body part which gives the toy added novelty for the user.

Details of other toy vehicles include U.S. Pat. No. 4,655,727, issued to Swisher et al. on Apr. 7, 1987; U.S. Pat. No. 5,766,056, issued to Tsai on Jun. 16, 1998; U.S. Pat. No. 6,527,619, issued to Agostini et al. on Mar. 4, 2003. Each of these patents is hereby expressly incorporated by reference in their entirety.

U.S. Pat. No. 4,655,727, issued to Swisher et al. on Apr. 7, 1987 entitled Toy Vehicle discloses a purely mechanical toy vehicle having a base or chassis with six freely spinning wheels and a top or body portion which is pivotally linked to the base of the toy vehicle by a pair of standoffs. The Swisher toy vehicle provides an external handle that is basically an extension of a lower part of the link which allows the user to rotate the entire top portion of the vehicle to a position higher than the base to give the toy vehicle a different overall appearance.

U.S. Pat. No. 6,527,619, issued to Agostini et al. on Mar. 4, 2003 entitled Projectile Firing Toy Vehicle discloses another toy vehicle that is purely mechanical and that has a mechanized accessory. Agostini discloses a toy fire truck of the free-wheeling variety that has a projectile launching tube rotatably mounted to the roof. The projectile launching tube is accompanied by a launching handle and a sound effect control handle. The launching handle is used to compress and release a launching spring. The sound effect control handle is used to raise and lower the launching tube and provides various buttons for initiating sound effects.

U.S. Pat. No. 5,766,056, issued to Tsai on Jun. 16, 1998 entitled Transmission Structure of Toy Fire Engine includes a small motor and gear system for propulsion and for operation of vehicle accessories. Tsai discloses a fire truck having a ladder that raises and lowers automatically by a power train that also causes a miniature fireman figure to scale and descend the ladder. The same power train also provides propulsion for the fire truck by way of a set of small drive wheels and causes other fireman figurines to partially rotate out the sides of the doors.

Amphibious toy vehicles were offered at one time by the Eldon Company and the Kader Company which had the capability of operation on rough surfaces or in water. Details of other amphibious toy vehicles include U.S. Pat. No. 4,652,247, issued to Goldfarb et al. on Mar. 24, 1987. These vehicles were driven by battery-powered mechanism and had a drive for propulsion in water. These toys were an improvement in the art over other water-play toys as these toys were capable of operating outside of the water without compromising their flotation abilities or their propulsion abilities. In the case of the paddlewheel toys, it does not appear that the paddlewheels would both at the same time touch a surface on which the toys were placed, and, even if they would, neither the paddlewheels nor the toy bodies generally were suitably configured to provide good traction or effective operation over rough surfaces. In the case of the rotating-limb toys, the dynamic visual effect of such toys operating on a dry surface would be to lurch forward erratically, producing—at best—generally a comic or silly impression.

However, the previous amphibious vehicles utilized the wheels as the flotation devices, which left the device susceptible to damage if the wheels were punctured in any manner. As will be recognized by one skilled in the art, wheels for toy vehicles suffer greatly at the hands of their child users. Therefore, there is a need in the art to improve the flotation capabilities of amphibious vehicles.

Further, the flotation devices used before created vehicles which were too large and unwielding for many track sets. This created a disconnect between the amphibious vehicles and the toy track sets for the other toy vehicles. It is known that the toy vehicles themselves are more attractive to consumers if there is a corresponding track set for the vehicle. Therefore, there is also a need in the art to improve the amphibious vehicles to provide a vehicle capable of utilizing a vehicle track set, thereby creating a cohesive product line which is attractive to children.

Track sets allow toy vehicles to be propelled through various track configurations at relatively high speeds. The toy vehicles typically used in toy vehicle track sets are either powered or unpowered. Powered vehicles typically employ a propulsion system utilizing a wind-up spring-driven power source or a battery-powered electric motor. Still others utilize a small electric motor deriving operative power from conductors buried in the trackway. Unpowered toy vehicles used in toy vehicle track sets are typically freewheeling and rely upon various energy sources to drive the vehicle around the trackway. The power sources may, for example, be simple gravity-driven systems using one or more inclined ramps for acceleration or, alternatively, may employ one of several types of acceleration devices. Acceleration devices may include launchers having a launching station from which the toy vehicle is accelerated using spring or air power. One of most prevalent acceleration devices utilizes one or more spinning wheels positioned adjacent a closed loop toy vehicle trackway. In such acceleration devices, the wheel or wheels are rotated at a high rotational speed and as a toy vehicle passes the spinning wheel or wheels, the wheel or wheels engage the toy vehicle and impart energy thereto.

Many innovative track sets for toy vehicles which have been produced by practitioners in the toy art have enhanced their play value by employing apparatus which might be generally described as stunt devices. Stunt devices are characterized generally in that they operate in combination with a toy vehicle track set and typically provide some play element which is activated by the proximity or passage of a toy vehicle through a stunt device.

Other innovative track sets have utilized slot track constructions. Generally, the track construction comprises track segments having one or more guide slots for engaging a projecting pin on a toy vehicle which guide the toy vehicle around the track. The toy vehicles are typically powered through a pair of conductors embedded in the track.

Prior art slot track constructions have presented various configurations of the guide slots. For example, multiple guide slots which merge into a single slot or guide slots which intersect in criss-cross fashion are known in the prior art, providing enhanced play action of the track and toy vehicles. However, the known slot track constructions utilize continuous guide slots along the length of the track. Toy vehicles cannot move freely on the slot track and if one of the cars comes free of the guide slot, the toy vehicle will not continue to operate. The art does not teach a track that utilizes guide mechanisms at strategic points on the track to direct the toy vehicle while still allowing the toy vehicle to move freely on the remainder of the track.

Details of other toy vehicles and vehicle tracks are contained in include U.S. Pat. No. RE32,106, issued to Lemelson on Apr. 8, 1986; U.S. Pat. No. 4,955,537, issued to Bratovz on Sep. 11, 1990; U.S. Pat. No. 5,752,678, issued to Riley on May 19, 1998; U.S. Pat. No. 6,089,466, issued to Fulton, et al. on Jul. 18, 2000; Each of these patents is hereby expressly incorporated by reference in their entirety.

U.S. Pat. No. RE32,106, issued to Lemelson on Apr. 8, 1986, entitled Toy Track and Vehicle Therefor discloses a toy guideway or track and vehicle for riding thereover. The track is made of a plastic material of such state and configuration wherein the track is not normally self supporting. Self support means are provided to support the track in a desired manner to define a trackway of particular configuration, and the track is provided with guide means for directing a toy vehicle thereover.

U.S. Pat. No. 4,955,537, issued to Bratovz on Sep. 11, 1990, entitled Model Railroad Track Having a Track Bed discloses a track for model railroads comprising a track bed, which simulates, e.g., a superstructure which is provided with a ballast bed. The track bed consists of a bar-shaped bed section, which is made of elastically and/or plastically deformable and preferably elastoplastic material and has a cross-sectional profile which simulates that of a typical superstructure and preferably has the configuration of an isosceles trapezoid without the closing longer side thereof. The side of the profile represents the road surface for receiving the track grate, the legs constitute slopes. The top surface of the bed section is provided with recesses, which are substantially complementary to the track grate so that the latter can be inserted into said recesses to a depth corresponding to at least part of the height of the sleepers or ties. The bed section is provided with stiffeners on its underside.

U.S. Pat. No. 5,752,678, issued to Riley on May 19, 1998, entitled Model Railroad Track Assembly with Actuator Located within Hollow Track Bed discloses a model railroad track assembly having a substantially rigid, one-piece molded plastic body with an upper surface molded to generally replicate at least a portion of a railroad track bed is provided. The track assembly has depending side walls extending generally downwardly from the upper surface to define a lower side having a hollow cavity. The body has at least two ends, with each end including a male latching member and a matingly complementary female engagement structure. The upper surface includes a molded-in guiding structure to receive and locate a preassembled piece of model railroad track, including at least two metal rails molded in place on a ladder-shaped member simulating a plurality of spaced-apart ties. The ends of the molded body are adapted for mating engagement with the ends of similar track assemblies having a similar piece of preassembled model railroad track with the rails on the engaged track ends being aligned. An actuator is positioned within the hollow cavity beneath the upper surface such that the actuator is contained within the cavity. The actuator is adapted to change a direction of travel of rolling stock traveling on the at least two rails or uncouple rolling stock traveling on the at least two rails.

U.S. Pat. No. 6,089,466, issued to Fulton, et al. on Jul. 18, 2000, entitled Roadbed for Model Railroads describes a structure for creating a roadbed for a model railroad. The structure includes an elongated and flexible section which has a top surface, a bottom surface and a pair of inwardly angled side surfaces. The side surfaces are angled such that the bottom surface is wider that the top surface. The section is made from a foam material which deadens the sound of model trains passing thereover and which cushions vibrations of model trains passing thereover. The top surface is a closed cell surface that allows model train track to be adhesively secured thereto and the bottom surface is a closed cell surface that allows the roadbed to be adhesively secured to a supporting surface While the foregoing described prior art devices have to some extent improved the art and have in some instances enjoyed commercial success, there remains nonetheless a continuing need in the art for evermore amusing, entertaining and interesting toy vehicle tracksets.

SUMMARY OF THE INVENTION

Briefly stated, in one aspect, the present invention is a switch-activated toy vehicle including a body, a chassis, and a lever. The body has a front end, a rear end, an interior and an exterior. The chassis accommodates the body and has at least a front wheel proximate the front end and a rear wheel proximate the rear end and a magnet embedded on the bottom of the chassis. A battery-operated motor is disposed within one of the body and the chassis and is drivingly coupled by a drive train to at least one of the wheels. The lever is movably supported on one of the chassis and the body of the toy vehicle so as to be accessible by a user for movement between a first position and a second position.

In use, a user moves the lever from the first position to the second position. Once the lever reaches the second position, the switch is made thereby allowing the batteries to supply power to the motor and a control circuit. The motor begins to rotate which, in turn, drives a gear train. The gear train also drives at least one of the wheels by way of a drive gear. The result is that the lever activated toy vehicle drives forward at a first speed.

The toy vehicle further includes an actuator mechanism operably coupled with the motor and configured to remove power from the motor once the actuator mechanism senses the toy vehicle has exceeded the first speed by either the vehicle being moved manually by a user or by moving downhill. Once the actuator mechanism has activated, the vehicle moves into free-wheeling mode and remains in that mode until the actuator mechanism senses that the toy has moved from the second speed faster than the first speed to a third speed slower than the first speed. Once the vehicle speed is slower than the first speed, the actuator mechanism is configured to restore power from the batteries to the motor and the gear train.

The actuation of the actuator mechanism is completely automatically mechanized and does not require any additional manipulation by the user after the initial actuation of the lever.

The trackset includes a raised end portion with remaining portion of the track resting upon a floor surface. A middle portion of the track is a flexible simulated terrain portion that provides a texturized surface for the toy vehicle to cross. Another end portion loop may be connected to the track.

The trackset includes concealed magnets each operative to draw a toy vehicle towards it or repel the toy vehicle, causing the vehicle to go through the track loops, up the raised end portion and over the track portions.

Other aspects and advantages of the present invention will be apparent from the following detailed description of the preferred embodiments and the accompanying drawing figures.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 7 is a top perspective view of a portion of the toy vehicle track;

FIG. 8 is a top perspective view of apportion of the toy vehicle track;

FIG. 9 is a front elevational view of the same showing the flex movements of the track;

FIG. 26 is a top perspective view of a toy vehicle;

FIG. 27 is top perspective view of the same with the toy vehicle removed from the toy vehicle chassis;

FIG. 28 is a top perspective view of the chassis of the toy vehicle alongside the battery container for the toy vehicle; and FIG. 29 is a top perspective view of the interior of the chassis of the toy vehicle;

FIG. 30 is a top perspective view of the interior of the chassis of the toy vehicle showing the magnet;

DETAILED DESCRIPTION OF THE INVENTION

Figure 1:
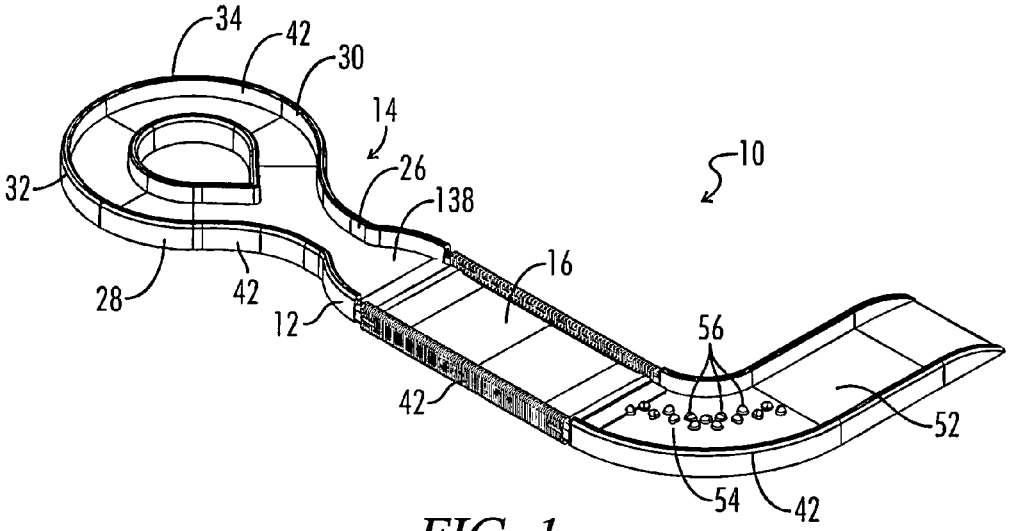
FIG. 1 is a top perspective view of a portion of the toy vehicle playset.
Figure 2:
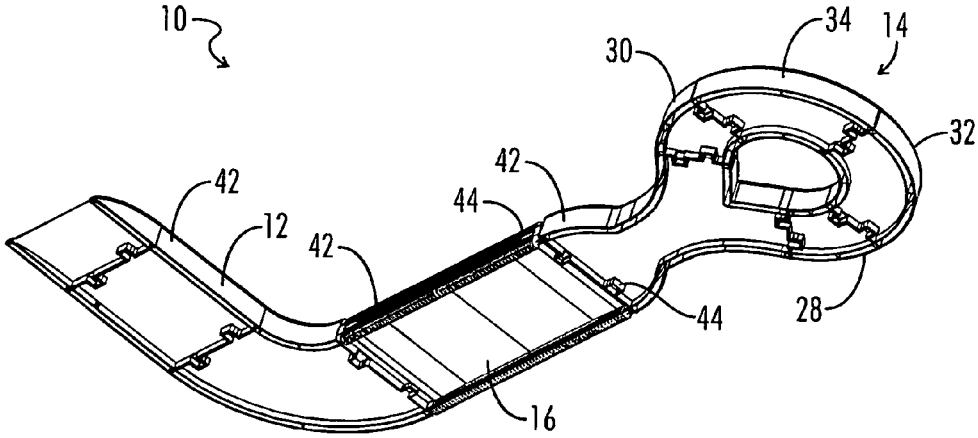
FIG. 2 is a bottom perspective view of the same.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the toy vehicle and designated parts thereof. The terminology includes the words above specifically mentioned, derivatives thereof and words of similar import.

A toy vehicle play set may include a track adapted for use with a toy vehicle. Such a play set may include a track assembly having a track with a first vehicle-support surface defining a travel path, and one or more vehicle-related assemblies disposed along the path. When a plurality of such vehicle-related, assemblies are provided, the vehicle-related assemblies may be independent of each other, or one or more of them may relate in some way. Many variations of such play sets may be envisioned. For example, for the purpose of increasing the level of enjoyment a person may derive from playing with a play set, a plurality of related vehicle-related assemblies may be provided.

An example of such a play set 10 having a plurality of track assemblies 12 is illustrated in FIGS. 1-6. For example, play set 10 may include one or more of such vehicle related assemblies as a loop assembly 14, a variable terrain assembly 16, a path assembly 18, a ramp assembly 20, jump assembly 22, a bridge assembly 24, and a overpass assembly 220. The track assemblies 12 may be configured in a variety of ways. For example, a play set may only include only one or a combination of the assemblies 12 shown, or may include other track assemblies 12, not shown. A track may include one or a plurality of track sections. The track may be formed with plastic, although other suitable materials, such as metal, may also be used. Furthermore, sections of the track may be molded, although they may also be formed in various other ways as well, such as by cutting or pressing. The track may be comprised of multiple sections that may need to be assembled by the user before using the track. The track may be assembled by various connectors, including any sort of snap fit structure, registration pins, retaining clips, flanges, or any other integral or non-integral structure capable of attaching two or more sections of the track together. Specific connectors are discussed in more detail in discussing FIG. 3. The track assemblies 12 may include side walls 42 along the perimeter of the track assemblies to maintain vehicles within the path of the track.

In the example shown in FIGS. 1-6, the loop assembly 14 may include a forked track section 26 having an entrance portion, a first travel path to the right and a second travel path to the left, a second, curved track section 28, 30 connected to either portion of the forked track section 26, and third, arcuate track section 32, 34, forming the top of the loop. The forked track can be a symmetrically forked track that creates a circular loop or it can have an oblong loop. The loop assembly 14 utilizes magnetic attraction or repulsion to manipulate the path taken by the toy vehicle. In past uses of magnetic attraction/repulsion, the magnets in either the toy vehicle and/or the track set required an electrical current to the magnetic strip to direct the movement of the car. Additionally, the track set required a continuous, exposed magnetic strip around the track to ensure that the toy vehicle maintained the connection with the magnetic strip. These requirements increase the cost of manufacture for the sets and increase the cost of maintaining the sets. The present invention utilizes covered or concealed magnetic or ferromagnetic elements strategically placed at turns to manipulate the direction of the toy vehicle. These concealed magnetic or ferromagnetic elements 36 are of sufficient strength that an electrical current is not required by either the vehicle or the track set.

Figure 3:
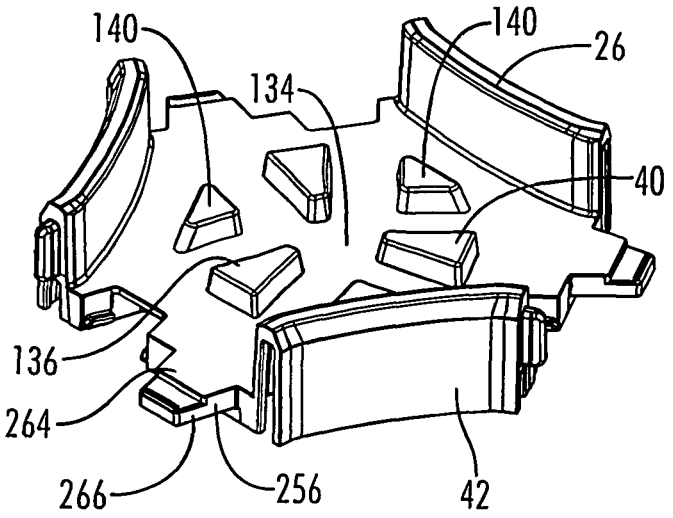
FIG. 3 is a top perspective view of the Y-portion of the toy vehicle playset shown in FIG. 1.
Figure 4:
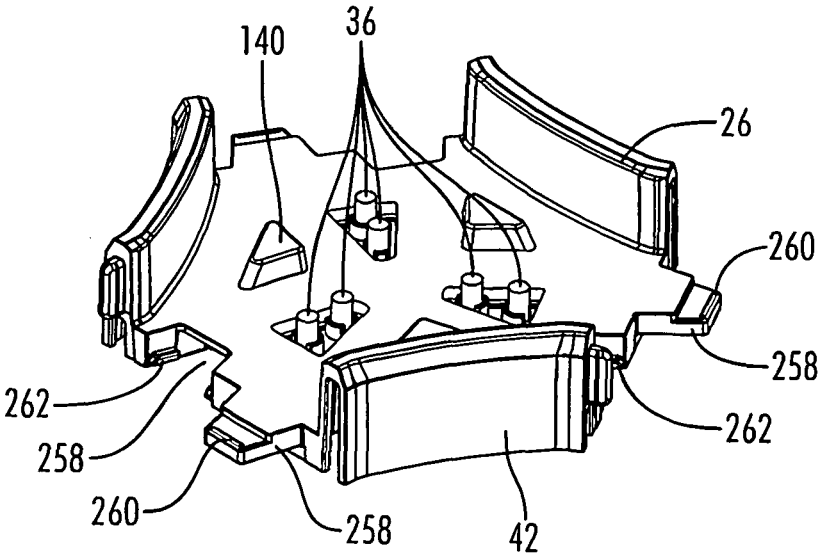
FIG. 4 is a top perspective of the same with the magnet covers removed.
Figure 5:
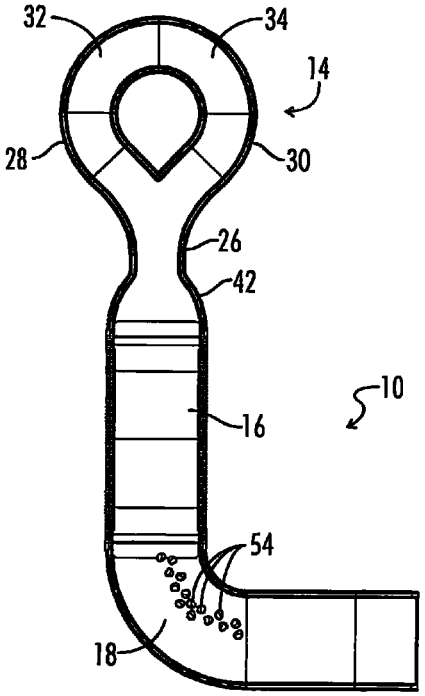
FIG. 5 is a top plan view of the same.
Figure 6:
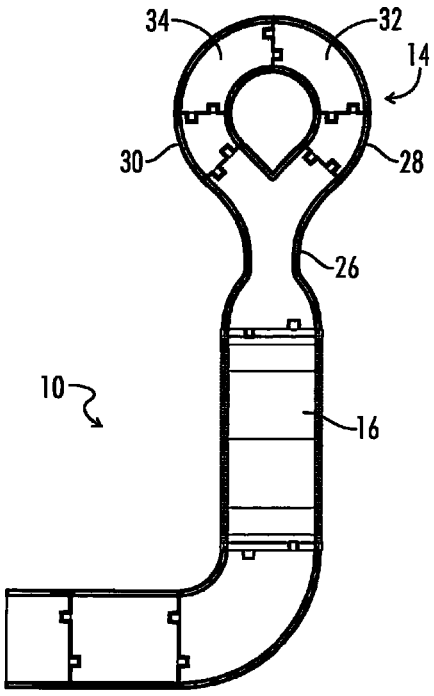
FIG. 6 is a bottom plan view of the same.

As shown in FIGS. 3-4, the looped assembly 14 has encased magnetic projections 136 above or below the track surface 138 within the forked track section 26 in the central area 134 of the forked section. Within the projections 136, magnetic or ferromagnetic material elements 36 are embed. In this manner, complementary magnetic attraction or repulsion between elements 36 and magnets 38 in the vehicle contribute to directing the vehicle on the track during travel. Optionally, elements 36 may be formed of magnetic material having a polarity opposite to that of the vehicle magnets 38, or the vehicle magnets may be replaced with ferromagnetic material. In both instances of the magnetic elements 36 and the vehicle magnets 38, the magnets themselves are covered by a thin layer of material to prevent immediate tactile contact with the magnets. This cover 40 prevents the magnet from dislodging, which could be particularly harmful to small children, and increases the child's excitement from playing with the toy as the magnet is virtually invisible, thereby leaving the child to believe the vehicle decided which direction to take independently. Random independent movement heightens a child's enjoyment of the toy and encourages the child's imagination.

The central portion 134 of the forked section includes stabilizing projections between the magnetic projections 136 with the magnetic projections and the stabilizing projections positioned in an alternating pattern. These stabilizing projections 140 act as guides to keep the toy vehicle wheels stable while running on the track when the toy vehicle repulsed either at left or right side of track.

As shown in FIG. 3-4, the track portions are connected by at least one series of male 256 and female ends 258. The male end 256 includes a flat portion 264 level with the track surface and a lower projection 266 below the track surface. The male end 256 forms a trapezoid shape from the track surface with the end of the lower projection 266 being the top end of the trapezoid. The end of the lower projection 266 includes a lip 260 projection that connects with the female end. The female end 258 includes an interior section configured to mate with the male end 256 and has two lip 262 portions on either side of the female end 258 configured to grip the angled sides of the male end 256. In construction of the track parts, the male end 256 fits within the female end 258 by inserting the connectors horizontally. In disassembly, the track portions are disconnected by lifting one side of the track to disengage the lip portions on the male and female ends.

The forked section 26 of the loop assembly 14 may extend from variable terrain assembly 16, a path assembly 18, a ramp assembly 20, jump assembly 22, or a bridge assembly 24. The end of the forked section 26 is open and may be connected to other assemblies by the track connectors 44.

As shown if FIGS. 1-6, a variable terrain assembly 16 is connected to the loop assembly 14. The variable terrain assembly 16 is formed with a plastic composed of primarily polyvinyl chloride and polypropylene. Flexible wires 148 are embedded within the variable terrain assembly 16. As shown in FIGS. 7-9, the variable terrain assembly is a flexible terrain capable of bending, twisting, and slanting upon user manipulation or an externally applied force, such as a user placing the terrain assembly between two other track assemblies and pushing them inward. The flexibility of the variable terrain assembly 16 allows a user to create different paths for the terrain by creating hills (by compressing the ends of the terrain together to push the length 46 of the terrain 16 upward) or inclines (by elevating on side of the terrain higher the opposing side). The wires embedded within the terrain 16 allow the terrain 16 to maintain its position along with the externally supplied force of the other assemblies or other elements. As shown in the figures, the sidewalls 42 of the variable terrain 16 are not a solid block structure as this would prevent the flexing movement of the sidewalls. In contrast, the sidewalls 42 are thin, staggered projections 48 with gaps 50 between each projection. When flexed, the projections can move forward and backward relative to the length 46 of the assembly 16 into the gaps 50.

The flexible terrain 16 can have a smooth surface 142 as shown in a portion of FIG. 7 or have a variable texture terrain 144. The variable texture terrain 144 is a molded surface that can feature a river pattern, rocks, or other road obstacles.

As shown if FIGS. 1-6, a path assembly 18 is connected to the variable terrain assembly 16. The path assembly 16 may generally include a generally flat surface 52 or may include a simulated terrain surface 54. The simulated terrain surface 54 may be composed of a multitude of bumps 56 or raised features that simulate a rocky terrain. As shown, the raised features 56 extend along the length of the path of the variable terrain assembly 16 piece. The raised features are strategically placed along the curve with the bumps being more dispersed along the beginning and ending of the curve and more concentrated at the apex of the curve. In this manner, the bumps 56 facilitate the toy vehicle 106 in maneuvering around the curve.

Figure 10:
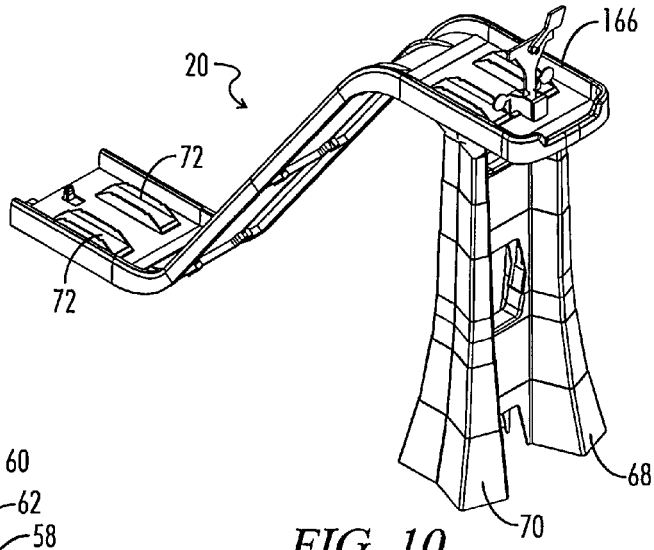
FIG. 10 is rear perspective view of a portion of the toy vehicle track.
Figure 11:
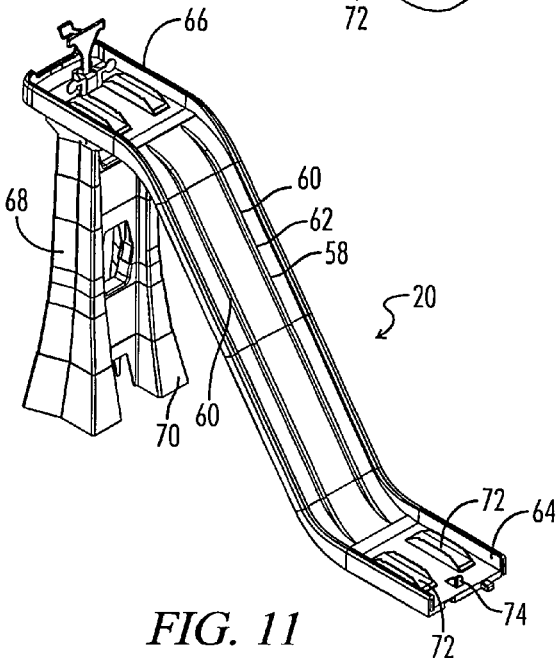
FIG. 11 is a front perspective view of the same.
Figure 12:
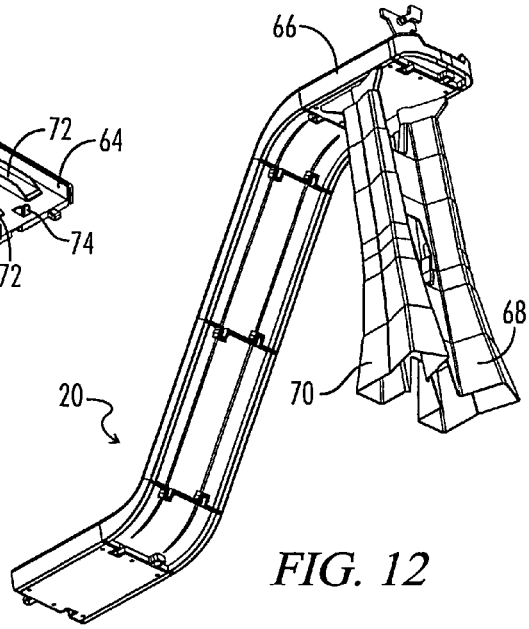
FIG. 12 is a bottom perspective view of the same.

FIGS. 10-12 depict ramp assembly 20 having a launch portion 64 and slanted track portions biased upwards to a raised terminus 66. The terminus 66 is raised above the launch portion 64 by supports 68, 70. The launch portion 64 has launching controls 72 configured to secure the chassis of the vehicle in place until released by the launch mechanism 74. Once the launch mechanism 74 is activated, the vehicles are then released on the path of the ramp assembly 20. The ramp assembly 20 includes two vehicle support surfaces each with a center portion 58 having a ferromagnetic strip 60 extending along the length of the track. This strip 60 may be continuous or discontinuous and is enclosed within a ridge 62 extending through the track 34. As mentioned above, complementary magnetic attraction between strip 60 and vehicle magnet 38 contribute to maintaining the vehicle on the track during travel. In use, the vehicle magnet 38 and strip 60 maintain a magnetic attraction to pull the vehicle up the incline of the ramp assembly 20.

Figure 13:
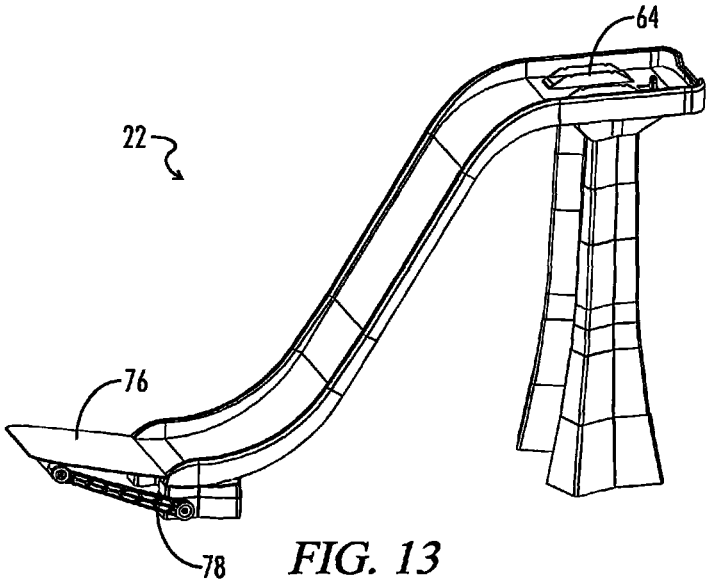
FIG. 13 is a left side perspective view of a portion of the toy vehicle track.
Figure 14:
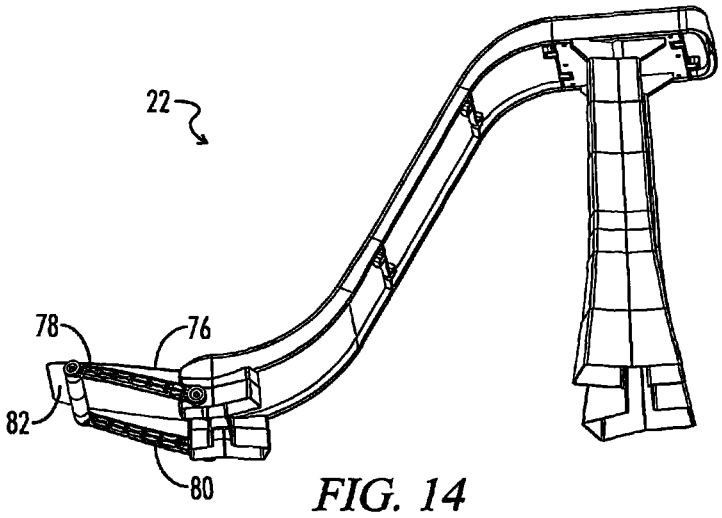
FIG. 14 is a bottom perspective view of the same.

FIGS. 13-14 depict jump assembly 22 having a launch portion 64 and slanted track portions biased downwards to a slanted planar terminus 76. The slanted track portions extend downward at a steady curve and terminus 76 is raised above the vertex of the curve by supports 78, 80. The supports 78, 80 are secured rotably to the base of the curve at an angle at one end of the support 78, 80 with the opposing end of the support secured to the underside 82 of the terminus 76. The launch portion 64 has launching controls 72 configured to secure the chassis of the vehicle in place until released by the launch mechanism 74. Once the launch mechanism 74 is activated, the vehicles are then released on the path of the jump assembly 20. Moving the launch controls 72 moves the launch mechanism 74 from the raised position securing the chassis toward the lowered position releasing the chassis.

The jump assembly 22 and ramp assembly 20 may be connected by a track portion extending from the back of both assemblies.

Figure 15:
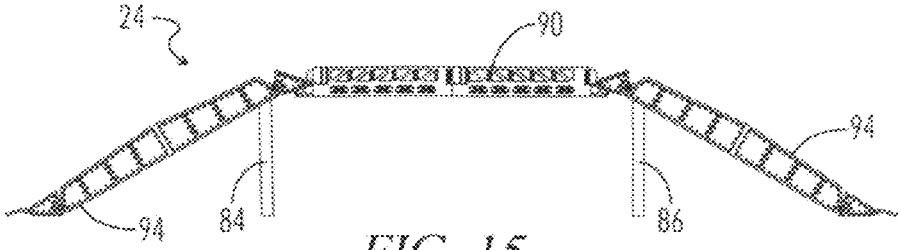
FIG. 15 is a left side elevational view of a portion of the toy vehicle track, the right side being a mirror image.
Figure 16:
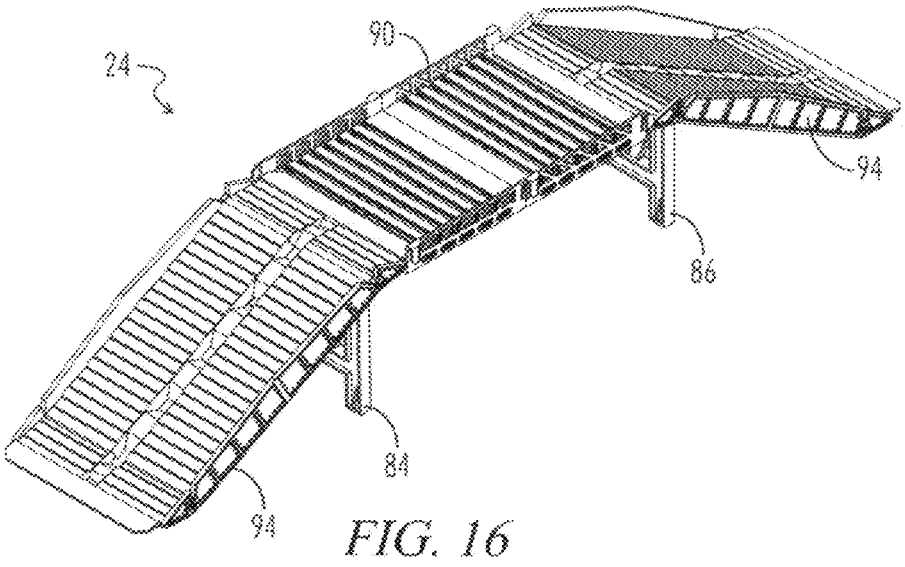
FIG. 16 is a top perspective view of the same.
Figure 17:
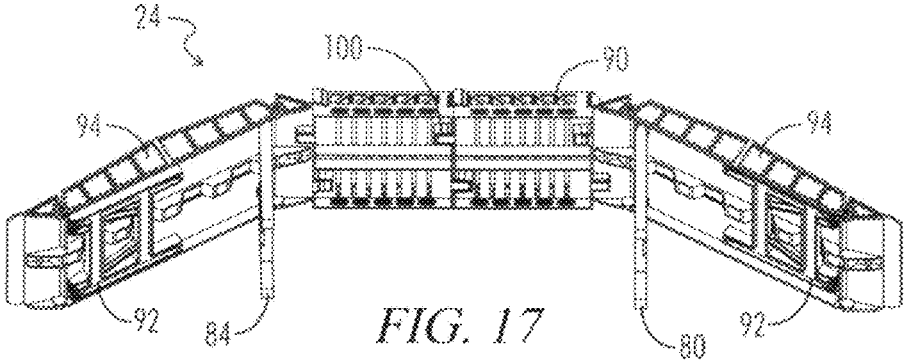
FIG. 17 is a bottom perspective view of the same.
Figure 18:
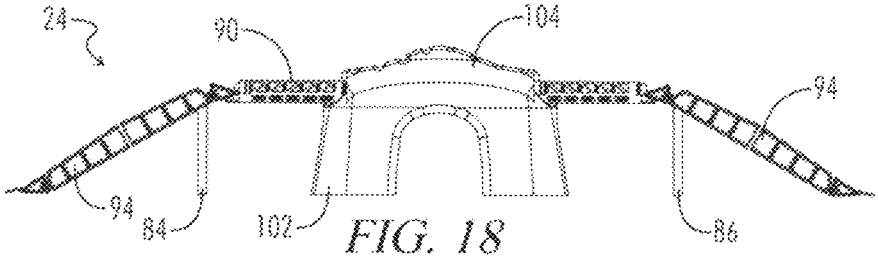
FIG. 18 is a left side elevational view of a portion of the toy vehicle track, the right side being a mirror image.
Figure 19:
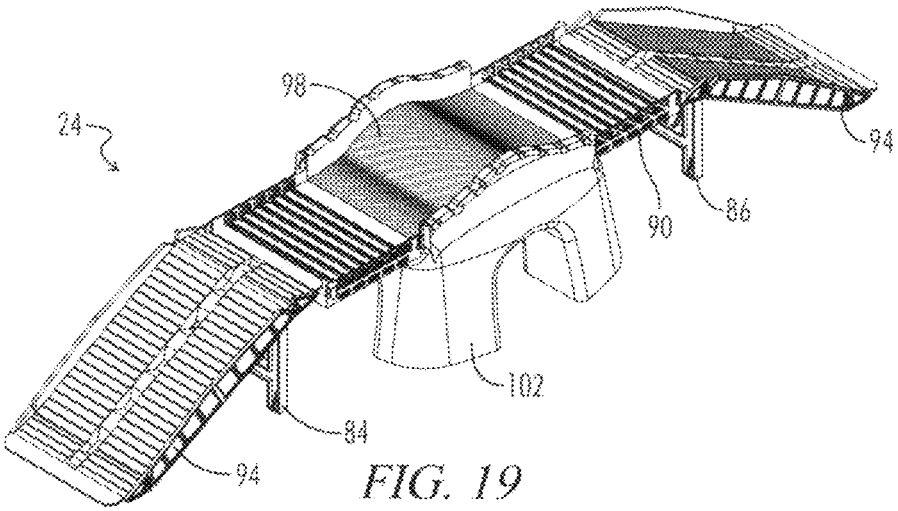
FIG. 19 is a top perspective view of the same.
Figure 20:
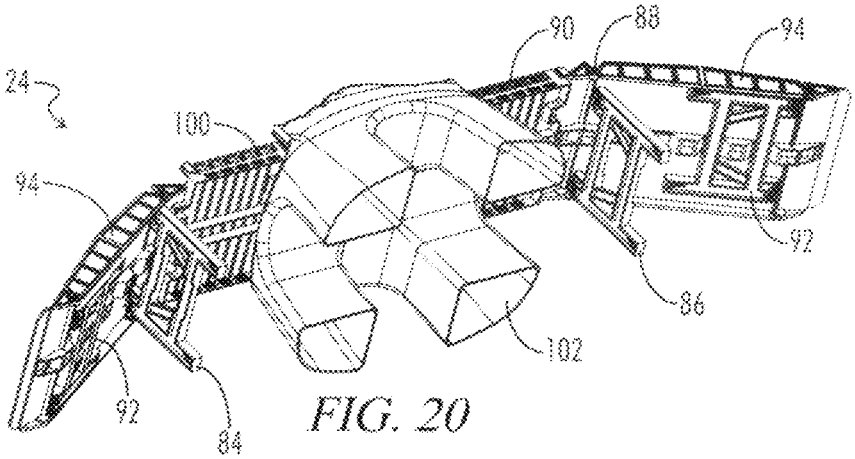
FIG. 20 is a bottom perspective view of the same.
Figure 21:
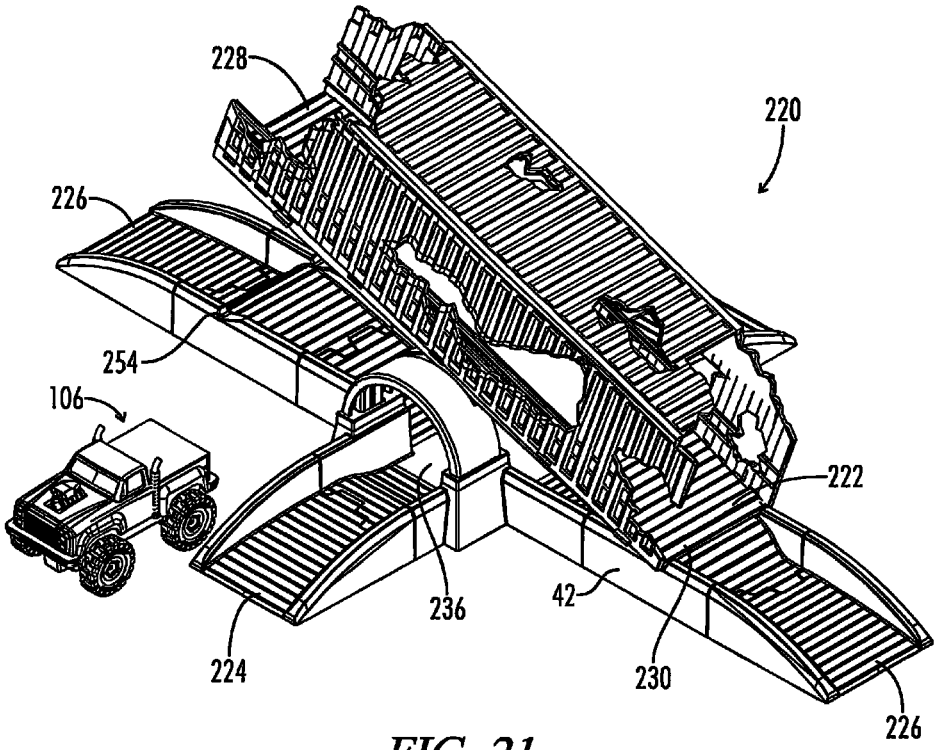
FIG. 21 is a front perspective view of a portion of the toy vehicle track.
Figure 22:
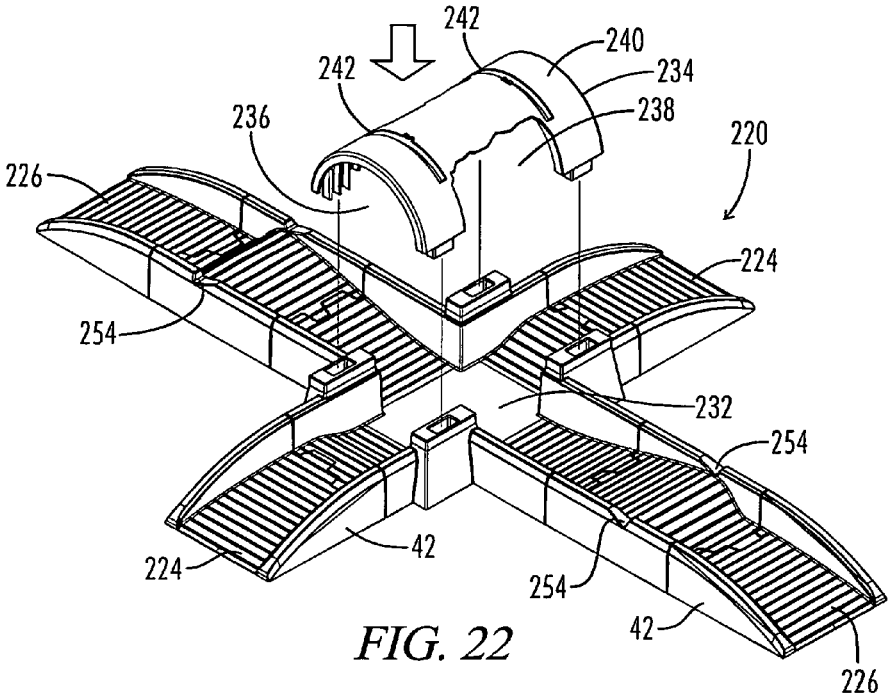
FIG. 22 is a front perspective view thereof showing the construction of the toy vehicle track.

FIGS. 15-17 depict one embodiment of bridge assembly 24. FIGS. 18-20 depict another embodiment of bridge assembly 24. As shown in the figures, the first embodiment of the bridge assembly features a flat elevated track 90 composed of two track portions connected together by connecting pieces 100. In the second embodiment, the elevated track includes an elevated sloped track 98 connected to the connecting pieces of the elevated track 90 and supported by supports 102. The sloped track 98 may include a fanciful aspect by addition of interesting molded plastic design element 104, such as the castle or cave design as shown in the figures. Each embodiment of bridge assembly generally features collapsible supports 84, 86 which may support an elevated track 90. Further supports, such as a secondary collapsible support 92 may support a portion of track section 94 with a decreasing elevation or adjust a portion of track section 94 from a decreased elevation forming a declining ramp while the secondary collapsible support 92 is in a first collapsed position to an increased elevation level with the elevated track 90 when the secondary collapsible support is in a second. Each collapsible support 84, 86, 92 is hingeably connected 88 to the base of the track section 94. The base of the track section 94 includes recesses for placement of the collapsible supports 84, 86, 92 when in a collapsed position. The track sections 94 are likewise hingeably connected to the elevated track portion 90 at one side of the track section 94 to allow for the movement of the track sections 94. On the opposite side of the track section 94. a declining ramp portion 96 is hingeably connected to the track section 94.

Figure 23:
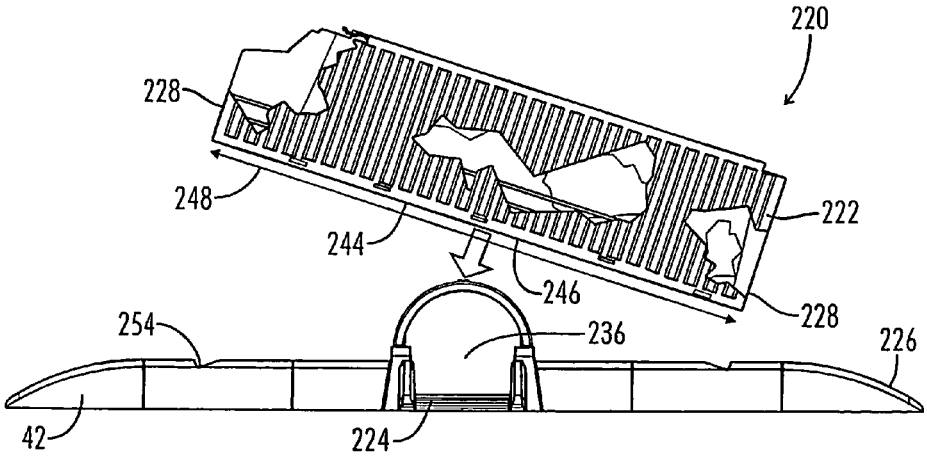
FIG. 23 is a front elevational view thereof showing the construction of the toy vehicle track.

FIGS. 21-25 depict an overpass assembly 220 that allows for a toy vehicle 106 to travel over a travel path by using an overpass path 222. As shown, the overpass assembly 220 includes a first travel path 224 that intersects 232 a second travel path 226. A barrel vault 234 forming a tunnel with two openings 236 for the first travel path 224 and two openings 238 for the second travel path 226 covers the intersection 232. The top 240 of the barrel vault 234 includes attachment grooves 242 that allow for the overpass path 222 to connect to the top 240 of the barrel vault 234. As shown in FIG. 23, the overpass path 222 base 244 rests pivotally on the top 240 of the barrel vault 234 at the midpoint 246 of the overpass path 222. The length 248 of the overpass path base 244 extends longitudinally along a portion of the length of the second path 226.

Figure 24:
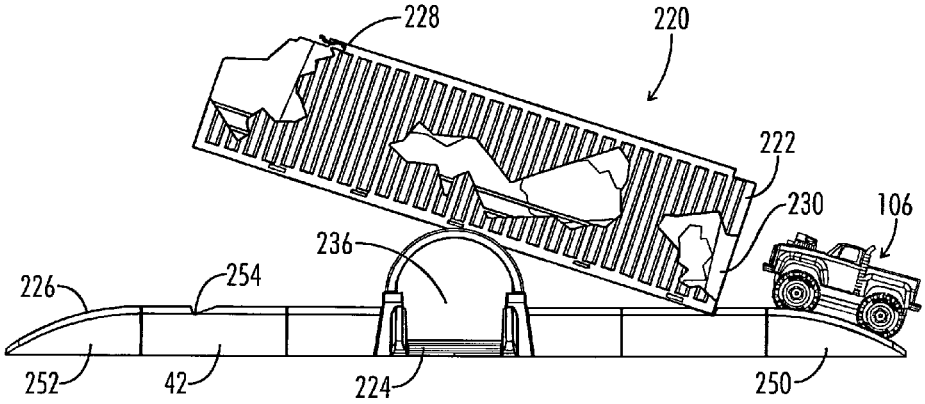
FIG. 24 is a front elevational view thereof.
Figure 25:
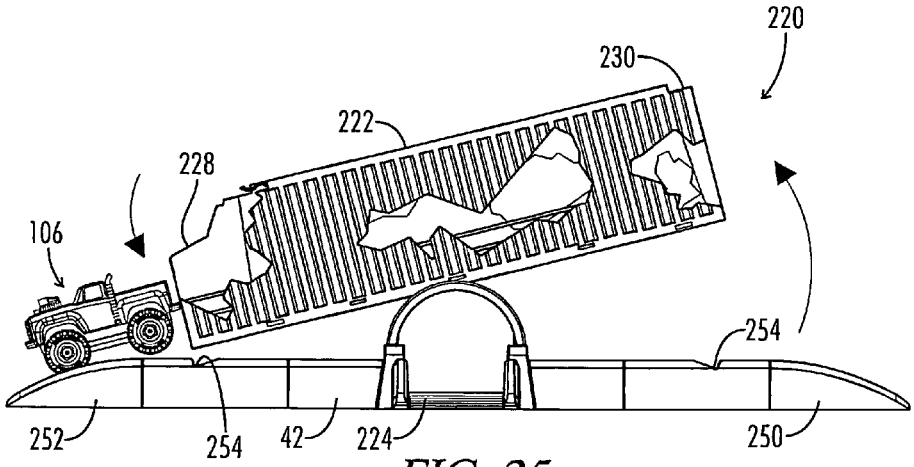
FIG. 25 is a front elevational view thereof showing the movement of the toy vehicle track.
Figure 31:
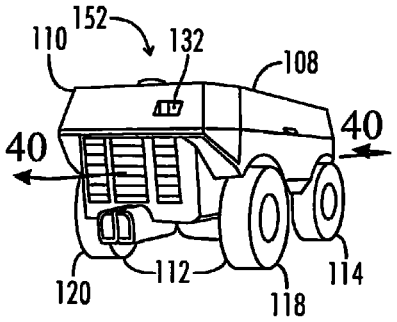
FIG. 31 is a rear perspective view of a second toy vehicle showing line 40-40.
Figure 32:
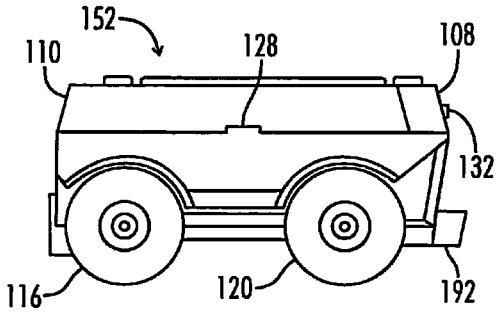
FIG. 32 is a right side elevational view of the same, the left side being a mirror image.
Figure 33:
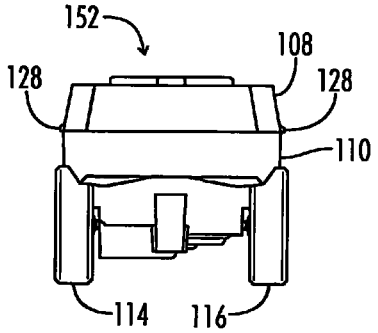
FIG. 33 is a front elevational view of the same.
Figure 34:
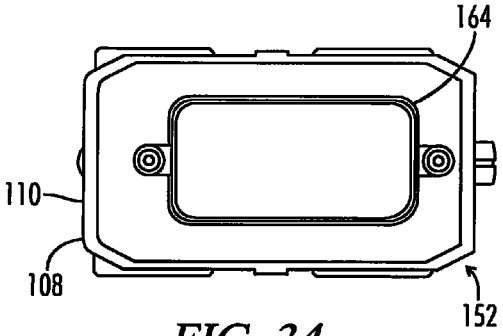
FIG. 34 is a top plan of the same.
Figure 35:
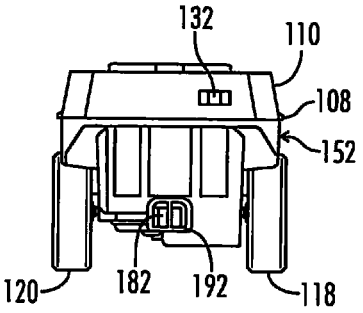
FIG. 35 is a rear elevational view of the same.
Figure 36:
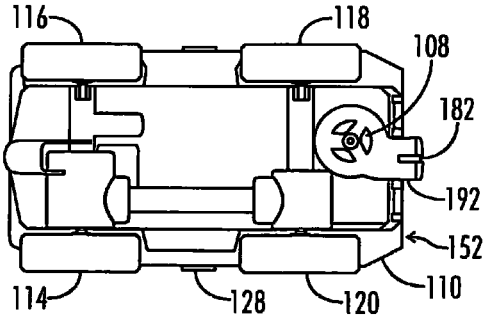
FIG. 36 is a bottom plan of the same.
Figure 37:
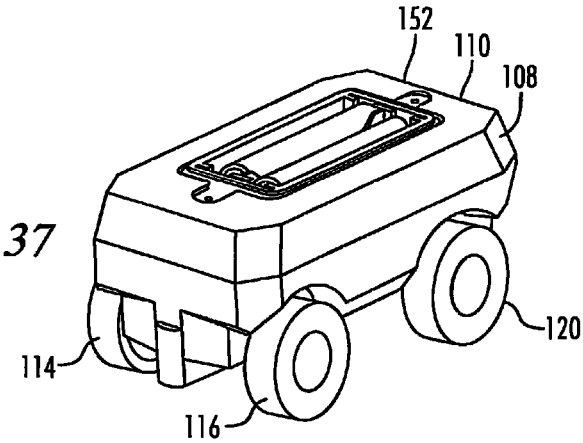
FIG. 37 is a top perspective of the same with the battery compartment cover removed.
Figure 38:
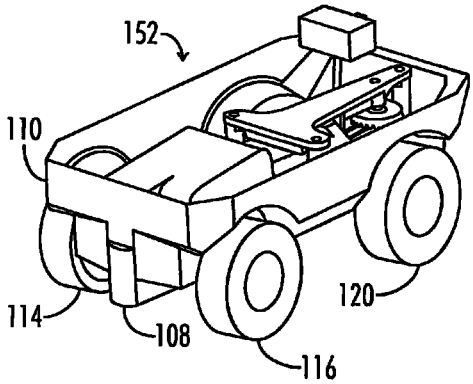
FIG. 38 is a top perspective of the interior chassis compartment of the second toy vehicle.
Figure 39:
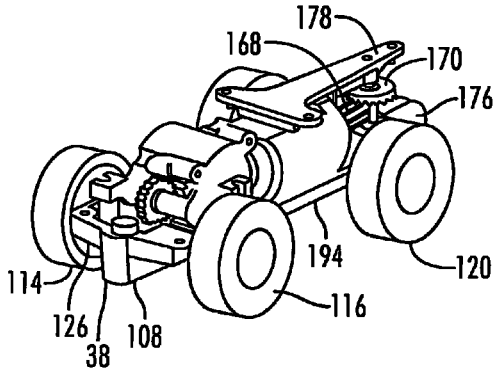
FIG. 39 is a top perspective of the internal mechanisms for the second toy vehicle.

As shown in FIGS. 24-25, the overpass path 222 is configured to pivot from resting at a first end 250 of the second path 226 to a second end 252. The second path 226 has notches in the sidewalls 42 that the overpass path 222 fits into. In play, the toy vehicle 106 can enter the first end 250 of the second path 226, travel into the overpass path 222 through the first end 230, the overpass path 222 can then pivot at the midpoint 246 to position the second end 228 of the overpass path 222 to connect with the second end 252 of the second path 226. During this movement, other toy vehicles can move through the first path 224 unencumbered.

As shown, the overpass path 222 can include decorative aspects, like apertures or embellishments to increase the appeal of the track.

As mentioned, a play set may be associated with a toy vehicle. The toy vehicles used on a toy vehicle track may utilize any suitable type of propulsion. For example, toy vehicles may allow the wheels on the toy vehicle to spin freely when pushed. Toy vehicles may also be propelled by an energy source, such as by using one or more batteries or other source of electric power, by using magnetic forces, by using mechanical forces such as provided by a spring, or by using an inertial flywheel motor that gains its rotational energy by spinning the wheels of the toy vehicle. Toy vehicles may maintain contact with a track in various ways. For example, contact between the vehicle and the track may be maintained by gravity, by utilizing the speed of the propelled toy vehicle, by using magnetic forces, and/or by securing the toy vehicle to the track mechanically.

In some examples, the toy vehicle may be unmotorized or may be motorized, and may have a single speed or a plurality of speeds. The vehicle-related assemblies may be configured to function with a toy vehicle having one or more particular characteristics. A toy vehicle may be configured to perform a given operation, with the toy vehicle including an operation-changing mechanism configured to be actuated selectively to change a given operation of the vehicle. For example, a toy vehicle may have a drive mechanism coupled to one or more wheels and be configured to drive the vehicle selectively in at least first and second speeds. In such a vehicle, the operation-changing mechanism may be a switch mechanism included in the drive mechanism and having a speed switch element movable for switching the speed of the vehicle.

In the example of play set 10, a self-propelled toy vehicle 106 may be provided. FIGS. 26-30 depict the chassis 108 and body 146 of the vehicle 106. The chassis of the toy vehicle 106 may include a body 110 housing a control circuit 130 and supported by a plurality of wheels 112, such as wheels 114, 116, 118, 120. As used herein, a wheel is considered the rotating structure on which the vehicle is supported, and includes what may be considered to be the tire, if any, as well as the rim on which a tire may be mounted. In the current invention, the toy vehicle 106 has a hard wheel with an outer tire wall composed having a tread and an inner side wall. The inner side wall is a softer plastic than the outer tire wall.

Each wheel may rotate about an axis of rotation. In this example, wheels 114 and 116 rotate about a common wheel axis 196. Wheels 118 and 120 may also rotate about a similar common wheel axis 122. The chassis body has a tooled bottom panel (not shown) that simulates a real vehicle's drive train and axles. The chassis 108 has two projecting ribs 128, one on each side, that allow for a vehicle body 146 to be attached to the chassis body 110. The chassis includes housings electrically connected to the control circuit 130 for headlights with LED bulbs installed within the housings and simulating functioning headlights. The control circuit 130 energizes the headlights 172 causing the headlights to illuminate or flash.

As indicated generally in FIGS. 29-30, toy vehicle 106 may also include an appropriate drive mechanism 124 to facilitate imparting rotational power to one or more of the toy vehicle wheels to drive the vehicle along the track in a way described below. Toy vehicle drive mechanisms are well known. The toy vehicle 106 may be a battery-powered toy vehicle. As shown in the figures, the toy vehicle may include a battery pack 150 which can be removed from the chassis 108 to allow for insertion of batteries. Other toy vehicles with or without drive systems may also be used, such as ones with drive systems that are wind-up, inertial-motor-powered, electric-powered or powered by any other drive mechanism. To activate the toy vehicle 106, a user must move a lever 132 to begin operation of the vehicle 106.

Figure 41:
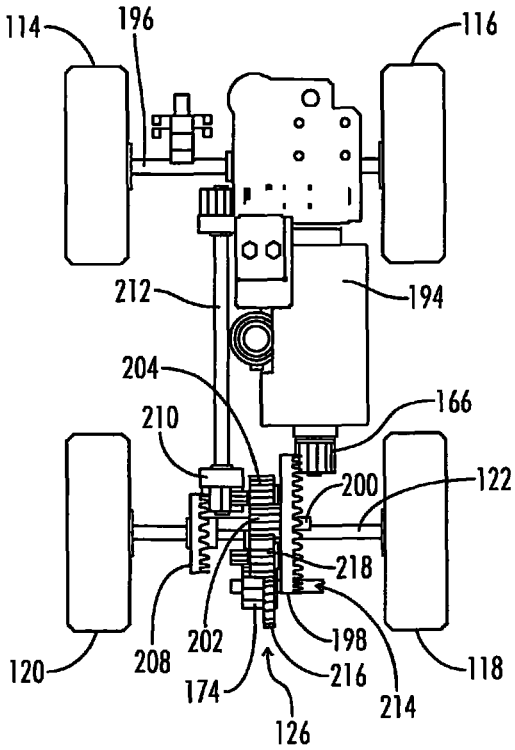
FIG. 41 is a top plan view of the drive mechanism for the toy vehicle.
Figure 42:
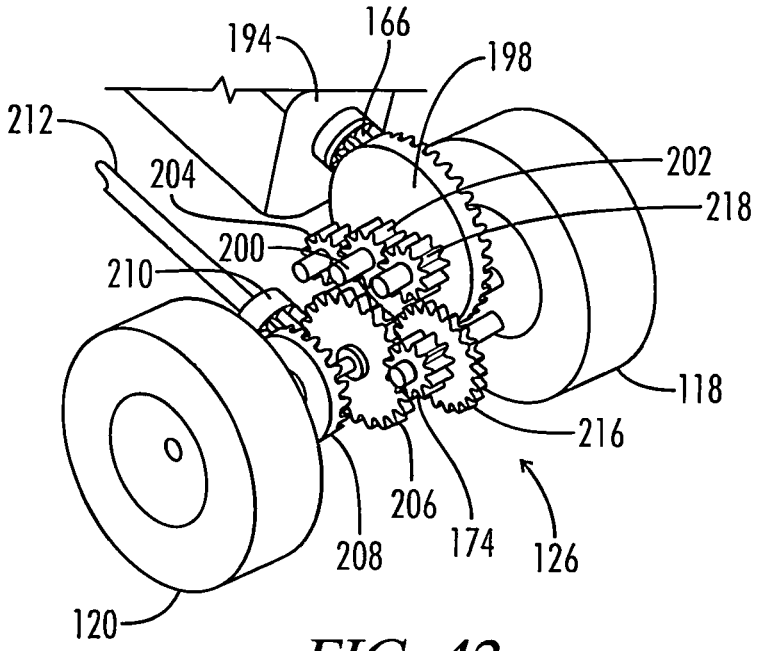
FIG. 42 is a front perspective of the same.
Figure 43:
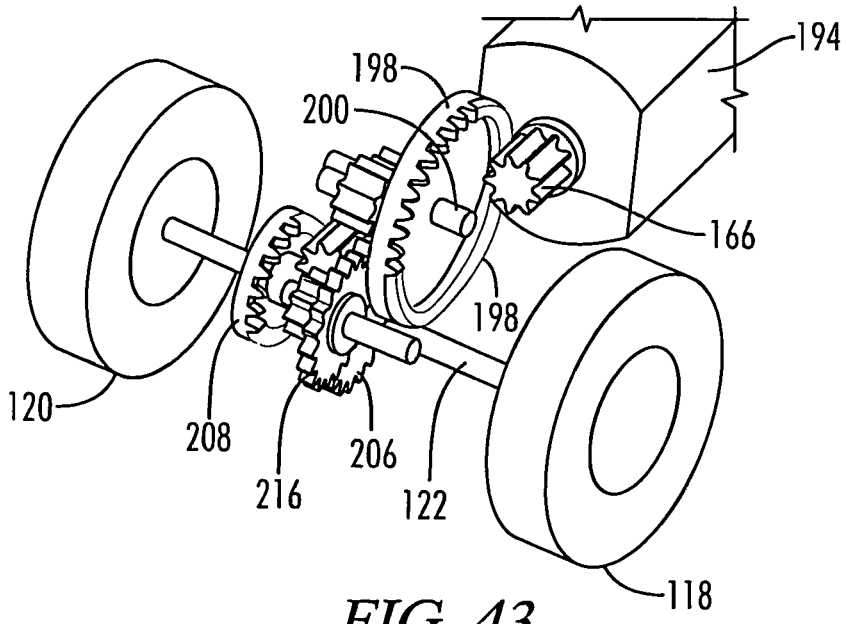
FIG. 43 is a front perspective of the same.

As shown in FIGS. 41-43, the drive mechanism of the toy vehicle 106 has a drive train including a drive pinion 166 mounted at the rear of the motor 194 and firmly secured for rotation with the drive mechanism. The rear drive pinion 166 is meshed with a crown gear 198, which rotates on a shaft 200 oriented parallel to the rear wheel axis 122. Sharing the crown-gear shaft 200 with the crown gear 198, and firmly secured to the crown-gear shaft 200 to rotate with it, is a spur gear 202. Below the spur gear 202, and oriented and disposed to mesh with it, is a second spur gear 204 oriented to rotate about axes parallel to the axes of wheel rotation. Below the second spur gear 204, and oriented and disposed to mesh with it, is a larger gear 206 fixed to the rear axle 122 and oriented to rotate about axes parallel to the axes of wheel rotation. The larger gear 206 drives the rear wheels 118, 120. Spaced apart from the larger gear 206, a second crown gear 208 is fixed to the front axle 196 and oriented to rotate about axes parallel to the axes of wheel rotation. A pinion 210 secured to a shaft 212 is meshed with the crown gear 208. The shaft 212 is oriented perpendicular to the rear wheel axis 122 and runs towards the front wheel axis 196 to engage the rear wheel gears to drive the rear wheels 118, 120.

Drive mechanism 124 may include an actuator gear mechanism 126 configured to change the propulsion of the vehicle from battery-powered to free-wheeling propulsion. The drive mechanism provides a plurality of different speeds for the vehicle, such as a slow speed and a fast speed. The actuator mechanism 126 features multiple gears operably coupled to the drive mechanism 124 and configured to remove power from the motor once the actuator mechanism 126 senses the toy vehicle has exceeded the first speed provided by battery-powered propulsion by either the vehicle being moved manually by a user or by moving downhill. The actuator mechanism 126 includes an actuator gear 174 operably coupled to the large axle gear 206 located on the rear axle 122 that drives the front wheel movement. The actuator gear 174 rotates on a shaft 214 oriented parallel to the rear wheel axis 122. Sharing the actuator-gear shaft 214 with the actuator gear 174, and firmly secured to the actuator-gear shaft 214 to rotate with it, is a second actuator gear 216. Above the second actuator gear 216, and oriented and disposed to mesh with it when the vehicle moves into free-wheeling propulsion, is a locking gear 218 oriented to rotate about axes parallel to the axes of wheel rotation. This locking gear 218 is oriented above the spur gear 202 located on the crown-gear shaft 200.

Once the axle gear 206 reaches a certain velocity, the actuator mechanism 126 is activated and the actuator gear 174 and second actuator gear 216 are motivated upwards to engage the locking gear 218 from rotational movement. This in turn locks the gear 202 on the crown-gear shaft 200, the crown gear 198, and the drive pinion 166, thereby removing the battery power from the motor from communicating with the rest of the drive mechanism. Once the actuator mechanism 126 has activated, the vehicle moves into free-wheeling mode and remains in that mode until wheel rotation and the axle gear 206 decrease in velocity from the second speed provided by free-wheeling propulsion that is faster than the first speed provided by battery-powered propulsion to a third speed slower than the first speed. Once the vehicle speed is slower than the first speed, the decreased rotational movement of the axle gear 206 allows the actuator gears 174, 216 to lower, disengageing from the locking gear 218 and allowing the rest of the drive mechanism gears to rotate, providing battery-powered propulsion from the motor to the drive mechanism 124.

The actuation of the actuator mechanism 126 is completely automatically mechanized and does not require any additional manipulation by the user after the initial actuation of the lever.

Furthermore, as discussed above, the toy vehicle 106 may include one or more magnets 38 in or on the underside of body 110. These magnets are contained within the chassis 108 and are not visible to the exterior of the chassis 108. The magnets may be in any suitable position on the toy vehicle. In this example, magnet 38 is aligned between wheels 118 and 120. The magnet 38 may be positioned on the vehicle so that when the vehicle is on a track, the magnets are elevated a sufficient distance above the track to avoid making direct contact with the track. As will be described, the vehicle magnets 38 may be positioned sufficiently low to provide a strong magnetic force of attraction with a movable or stationary track element having a magnetic or ferromagnetic material.

In use, a user moves the lever 132 from the first position to the second position. Once the lever 132 reaches the second position, the switch is made thereby allowing the batteries to supply power to the drive mechanism 124 and a control circuit 130. The motor begins to rotate which, in turn, drives a gear train 126. The gear train 126 also drives at least one of the wheels by way of a drive gear. The result is that the battery-operated toy vehicle drives forward at a first speed.

In the example of play set 10, a self-propelled amphibious toy vehicle 152 may be provided. FIGS. 31-40 depict the chassis 108 and body 146 of the amphibious vehicle 152. The chassis of the toy amphibious vehicle 152 may include a body 110 housing a control circuit 130 and supported by a plurality of wheels 112, such as wheels 114, 116, 118, 120. As used herein, a wheel is considered the rotating structure on which the vehicle is supported, and includes what may be considered to be the tire, if any, as well as the rim on which a tire may be mounted. Each wheel may rotate about an axis of rotation. In this example, wheels 114 and 116 rotate about a common wheel axis (not shown). Wheels 118 and 120 may also rotate about a similar common wheel axis (not shown). The chassis body has a tooled bottom panel that simulates a real vehicle's drive train and axles. The chassis 108 has two projecting ribs 128, one on each side, that allow for a vehicle body 146 to be attached to the chassis body 110. The chassis includes housings electrically connected to the control circuit 130 for headlights with LED bulbs installed within the housings and simulating functioning headlights. The control circuit 130 energizes the headlights causing the headlights to illuminate or flash.

As indicated generally in FIG. 40, toy amphibious vehicle 152 may also include an appropriate drive mechanism 124 to facilitate imparting rotational power to one or more of the toy vehicle wheels to drive the vehicle along the track in a way, described below. Toy vehicle drive mechanisms are well known. The toy amphibious vehicle 152 may be a battery-powered toy vehicle. To activated the toy amphibious vehicle 152, a user must move a lever 132 to begin operation of the amphibious vehicle 152.

The drive mechanism of the amphibious vehicle 152 differs slightly than that of the toy vehicle 106 in that the drive mechanism 124 also imparts rotational power to the impeller 154 that provides propulsion in a liquid environment. Like with the toy vehicle 106, a drive pinion 166 is mounted at the front of the drive mechanism 124. An additional drive pinion 168 is mounted at the back of the drive mechanism in the amphibious vehicle 152. Both drive pinions 166, 168 are firmly secured for rotation with the drive mechanism.

As with the toy vehicle 106, the front drive pinion 166 of the amphibious vehicle 152 is meshed with a spur gear, which rotate on a corresponding shafts oriented parallel to the drive mechanism. Sharing the spur-gear shaft with the spur gear, and firmly secured to the spur-gear shaft to rotate with it, is a worm. Below the worm, and oriented and disposed to mesh with it, is a worm gear oriented to rotate about axes parallel to the axes of wheel rotation. The worm gears and wheels are fixed to the front axle; thus the worm gear drives the front wheels.

Figure 40:
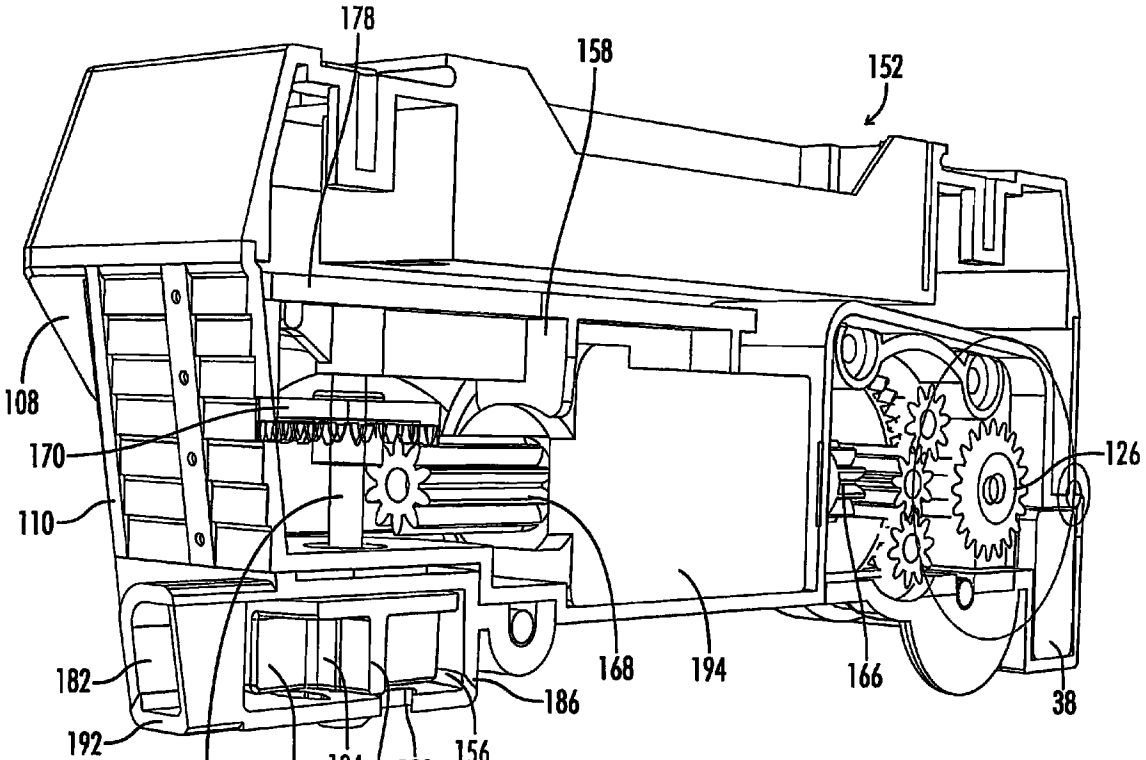
FIG. 40 is cross-sectional view of the second toy vehicle along line 40-40.

As shown in FIG. 40, the back pinion 168 rotates a crown gear 170 operably connected to the impeller 154. The crown gear 170 is keyed to the top end of a short vertical shaft 176 that is suspended from a T-shaped support 178 secured to the top of the drive mechanism 124 and that passes through the floor of the chassis 108 and an o-ring seal 160 which seals the chassis compartment 158 from the impeller chamber 156. The impeller 154 is fixed to the bottom end of the shaft 176 comprising multiple projections in a substantially circular array. The crown gear 170 spins the impeller 154 through the vertical shaft 176, being driven by the rear pinion 168. When the impeller 154 is immersed and spins, the projections force water from the intake apertures 180 below the impeller through the spaces 184 between the projections 186 to the exhaust side 182 at the rear of the vehicle.

The impeller chamber 156 on the underside of the chassis 108 encloses the impeller 154. The impeller chamber 156 has a peripheral wall 188 that closely encloses the impeller 154, except in one small area where an output nozzle 190 is formed. Within the nozzle 190, a duct provides water communication between the peripheral exhaust side of the impeller and the environment—i.e., the pool of water in which the vehicle is typically floating during aquatic operation. The impeller chamber 156 also has a bottom wall 192 that is closely adjacent to the underside of the impeller 154, except at an intake aperture 180 formed in the center of the bottom wall 192. The intake aperture 180 provides communication between the environment and the central intake area of the impeller.

The amphibious vehicle 152 differs from the standard vehicle 106 in terms of its flotation capabilities and its propulsion. The chassis 108 of the amphibious vehicle 152 acts as the flotation chamber 158. The chassis 108 has a top cover 164 which is sealed over the top of the interior of the chassis containing a magnet 28, the drive mechanism 124, and a gear mechanism for propulsion in water. The cover 164 also has a formed recess for the batteries, and within that recess carries contacts (not illustrated) for electrical connection of the batteries to the drive mechanism 124. The chassis 108, once sealed, forms a flotation chamber 158 that maintains the buoyancy of the vehicle 152 when in a liquid environment.

Like with the toy land vehicle 106, the drive mechanism 124 of the amphibious vehicle 152 may include an actuator mechanism 126 configured to change the propulsion of the vehicle from battery-powered to free-wheeling propulsion. The amphibious vehicle 152 also includes an gear mechanism 126 operably coupled to the drive mechanism 124 and configured to provide power the impeller to provide propulsion Furthermore, as discussed above, the toy amphibious vehicle 152 may include one or more magnets 38 in or on the underside of body 110. These magnets are contained within the chassis 108 and are not visible to the exterior of the chassis 108. The magnets may be in any suitable position on the toy vehicle. In this example, magnet 38 may be aligned between wheels 118 and 120. The magnet 38 may be positioned on the vehicle so that when the vehicle is on a track, the magnets are elevated a sufficient distance above the track to avoid making direct contact with the track. As will be described, the vehicle magnets 38 may be positioned sufficiently low to provide a strong magnetic force of attraction with a movable or stationary track element having a magnetic or ferromagnetic material.

An exemplary method of game play utilizing the play set 10 will now be outlined. The user may begin by activating a multi-speed toy vehicle 106. The user may begin by activating the toy vehicle to use battery-powered propulsion or by free-wheeling movement on the track, sufficient for the vehicle to travel along the play set 10 to one or a plurality of track assemblies 12. For the purposes of this illustration, the vehicle 106 will be placed in battery-powered propulsion mode.

Next, the toy vehicle 106 may be positioned to enter the loop at the fork 26 of the loop assembly 14. When the toy vehicle enters the fork section 26, the direction of the toy vehicle 106 may be changed when the magnets 36 in the fork 26 respond to the magnet 38 of the vehicle, resulting in the shifting of direction of the toy vehicle.

After leaving the loop assembly 16, the toy vehicle may be directed to the ramp assembly 20. When the toy vehicle enters the ramp, the toy vehicle 106 will be encouraged to climb the ramp by the battery-powered propulsion in combination with the magnets 36 in the ramp as the magnets 36 respond to the magnet 38 of the vehicle.

The toy vehicle may be placed on the jump assembly 22. When the toy vehicle is placed on the jump assembly 22, the toy vehicle 106 will be launched down the slanted portions. If the previous propulsion of the toy vehicle was battery-powered propulsion, the propulsion of the toy vehicle may be shifted to a free-wheeling propulsion.

Several aspects of this exemplary method of game play may be modified from that disclosed above. Play may thus be configured to provide a game with a desired degree of complexity or difficulty, for example to adapt the game to players of a predetermined age range.

The play set 10 has various general features. Any one or more of these assemblies may be provided in a play set. However, the combination of assemblies provide an interactive and action-varying play set that involves the action and skills of the user.

Accordingly, it is believed that the disclosure set forth above encompasses multiple distinct inventions with independent utility. Selected inventions are defined by the appended claims. While an example of each of these inventions has been disclosed in a preferred form, the specific examples thereof as disclosed and illustrated herein are not to be considered in a limiting sense as numerous variations are possible. The subject matter of the disclosures includes all novel and non-obvious combinations and subcombinations of the various elements, features, functions and/or properties disclosed herein.

Similarly, where "a" or "a first" element or the equivalent thereof is recited, such usage should be understood to include incorporation of one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

INDUSTRIAL APPLICABILITY

The methods and apparatus described in the present disclosure are applicable to toys, games, and other devices, and other industries in which amusement devices are used.

What is claimed is:

1. A toy vehicle play set comprising:

a toy vehicle configured to perform a given operation, the toy vehicle comprising a chassis having first and second opposite sides, a plurality of wheels including a first wheel on the first side of said chassis and a second wheel on the second side of said chassis and spaced apart from the first wheel, a drive mechanism drivingly coupled to one or more of the wheels for propelling the toy vehicle, and a magnet enclosed within said chassis between said first wheel and said second wheel, said magnet having a magnetic force configured to respond to other magnetic elements;

a track assembly including a track having a surface defining a travel path and having multiple covered magnetic elements configured to attract or repel said toy vehicle along said travel path, said track further comprising:

a forked track section having an entrance section;

a first travel path;

a second alternate travel path;

said multiple covered magnetic elements positioned between said first travel path and said second alternate travel path and configured to attract or repel said toy vehicle towards one of either said first travel path or said second alternate travel path; and stabilizing projections positioned between said first travel path and said second travel path, said magnetic elements and said stabilizing projections positioned in an alternating pattern.

2. The play set of claim 1, in which the track includes a variable terrain path configured to flex in response to an externally applied force to form an incline and maintain said incline.

3. The play set of claim 1, in which the travel path includes a textured terrain.

4. The play set of claim 1, in which the track includes an overpass path section having a tunnel having a top and an overpass pivotally attached to the top of said tunnel, said overpass configured to pivot from resting at a first end of the travel path to a second end of the travel path.

5. A toy vehicle comprising:

a chassis having first and second opposite sides and an air-tight container configured to contribute to flotation during operation in a liquid environment;

a motor configured to impart rotational movement and mounted to said chassis;

a plurality of wheels including a first wheel on the first side of said chassis and a second wheel on the second side of said chassis and spaced apart from said first wheel, said first wheel and said second wheel having a common wheel axle;

a drive mechanism operably coupled said motor and to one or more of the wheels for imparting rotational movement from said motor to one or more of the wheels of the toy vehicle to propel the toy vehicle in a direction, said drive mechanism having a drive train comprising:

a crown gear proximate to said motor configured to impart rotational movement from said motor to said drive train;

an axle gear on said common wheel axle; and a locking gear proximate to said crown gear and configured to mesh with said crown gear;

at least one power source operably coupled to said motor to power the motor; and an actuator mechanism proximate to said drive mechanism and configured to disengage said rotational movement imparted from said motor upon said toy vehicle reaching a first velocity, said actuator mechanism configured to engage said locking gear of said drive train once said rotational movement of said axle gear reaches a first velocity and restrict the rotational movement of said crown gear, thereby restricting the rotational movement imparted from said motor, said actuator mechanism configured to disengage from said locking gear once said rotational movement of said axis gear reaches a second velocity slower than said first velocity, thereby allowing said crown gear to rotate to provide rotational movement from said motor to said drive mechanism.

6. The toy vehicle of claim 5 further comprising a magnet enclosed within said chassis, said magnet having a magnetic force configured to respond to other magnetic elements.

7. The toy vehicle of claim 5, further comprising an impeller rotatably mounted to the frame and disposed for immersion in such water when the vehicle is in operation along such a water surface, the impeller having an intake side and an exhaust side.

8. The toy vehicle of claim 5, said actuator mechanism further comprising:

an actuator gear operably coupled to said axle gear and on a shaft oriented parallel to said common wheel axis;

a second actuator gear positioned on said shaft and configured to rotate with said actuator gear, said second actuator gear positioned proximate to said locking gear and configured to mesh with said locking gear upon said toy vehicle reaching said first velocity.

9. A toy vehicle play set comprising:

a toy vehicle configured to perform a given operation, the toy vehicle comprising:

a chassis having first and second opposite sides;

a motor configured to impart rotational movement and mounted to said chassis;

a plurality of wheels including a first wheel on the first side of said chassis and a second wheel on the second side of said chassis and spaced apart from said first wheel, said first wheel and said second wheel having a common wheel axle;

a drive mechanism operably coupled said motor and to one or more of the wheels for imparting rotational movement from said motor to one or more of the wheels of the toy vehicle to propel the toy vehicle in a direction;

at least one power source operably coupled to said motor to power the motor;

an actuator mechanism proximate to said drive mechanism and configured to disengage said rotational movement imparted from said motor upon said toy vehicle reaching a first velocity until said toy vehicle reaches a second velocity slower than said first velocity;

a magnet enclosed within said chassis, said magnet having a magnetic force configured to respond to other magnetic elements;

a track assembly including a track having a surface defining a travel path and having multiple covered magnetic elements configured to attract or repel said toy vehicle along said travel path, said track further comprising:

a forked track section having an entrance section;

a first travel path;

a second alternate travel path; and multiple stabilizing projections and said multiple covered magnetic elements positioned between said first travel path and said second alternate travel path, said magnetic elements and said stabilizing projections positioned in an alternating pattern.

10. The toy vehicle of claim 9, said drive mechanism having a drive train comprising:

a crown gear proximate to said motor configured to impart rotational movement from said motor to said drive train;

an axle gear on said common wheel axle; and a locking gear proximate to said crown gear and configured to mesh with said crown gear.

11. The play set of claim 9, in which the track includes a variable terrain path configured to flex in response to an externally applied force to form an incline and maintain said incline.

12. The play set of claim 9, in which the travel path includes a textured terrain.

13. The toy vehicle of claim 9, said chassis further comprising an air-tight container configured to contribute to flotation during operation in a liquid environment.

14. The toy vehicle of claim 13, further comprising an impeller rotatably mounted to the frame and disposed for immersion in such water when the vehicle is in operation along such a water surface, the impeller having an intake side and an exhaust side.

15. The play set of claim 9, in which the track includes an overpass path section having a tunnel having a top and an overpass pivotally attached to the top of said tunnel, said overpass configured to pivot from resting at a first end of the travel path to a second end of the travel path.

* * * * *